United States Patent [19]

Frank et al.

[11] 4,317,979

[45] Mar. 2, 1982

[54] HIGH CURRENT HIGH FREQUENCY CURRENT TRANSFORMER

[75] Inventors: William E. Frank; Erwin A. Billman, both of Baltimore, Md.

[73] Assignee: Westinghouse Electric Corp., Pittsburgh, Pa.

[21] Appl. No.: 154,692

[22] Filed: May 30, 1980

[51] Int. Cl.[3] ..... H05B 6/06; H01F 40/06

[52] U.S. Cl. ..... 219/10.77; 219/10.75; 219/10.49 R; 323/358; 324/127; 336/60; 336/174; 336/175

[58] Field of Search ..... 219/10.77, 10.75, 10.79, 219/10.49 R; 336/173, 174, 175, 60; 324/127; 323/357, 358

[56] References Cited

U.S. PATENT DOCUMENTS

| | | | |
|---|---|---|---|
| 2,924,796 | 2/1960 | Stauber et al. | 336/174 X |
| 2,935,589 | 5/1960 | Baer et al. | 219/10.79 X |
| 3,631,524 | 12/1971 | Denner | 219/10.79 X |
| 3,663,782 | 5/1972 | Emerson | 219/10.79 X |
| 3,746,825 | 7/1973 | Pfaffmann | 219/10.77 |
| 3,946,349 | 3/1976 | Haldeman | 219/10.79 X |
| 3,961,151 | 6/1976 | Danner | 219/10.79 X |
| 3,990,001 | 11/1976 | Schiemann | 336/174 X |

*Primary Examiner*—B. A. Reynolds
*Assistant Examiner*—Philip H. Leung
*Attorney, Agent, or Firm*—C. M. Lorin

[57] ABSTRACT

In an induction heating apparatus, direct sensing of the high frequency high power current flowing in the tank circuit to load the induction coils, is obtained with a coil current measuring transformer comprising one of the power current busses leading to the induction coil and a secondary winding of many ampere-turns wound around said one bus. The bus is given a half-loop shape to accommodate the secondary winding. The secondary winding is made of a magnetic core wound with many turns of Litz wire. Cooling tubes are cemented outside the wound secondary with conductive cement to form a heat sink with a circulation of cooling medium through the tube. The cement is divided in two parts separated by gaps to prevent circulation of induced currents. A cooling tube is installed between the core and wound wire to provide an internal heat sink.

6 Claims, 8 Drawing Figures

HIGH CURRENT HIGH FREQUENCY CURRENT TRANSFORMER

BACKGROUND OF THE INVENTION

The invention relates to high frequency induction heating in general, and more particularly to a current measuring transformer which is particularly adapted for control of an induction heating apparatus in response to coil current directly measured.

Control of the induction heating apparatus is essential for an efficient operation and for adapting an existing equipment and power supply to a wide range of workpieces of different shape, geometry, and material.

A customary approach with induction heating apparatus has been to control the voltage or the power of the coil circuit from the electrical power source. These methods have not been satisfactory because the final temperature for the workpiece treated is never obtained with sufficient precision and manual adjustment has been required in general.

Where the final temperature is critical, the prior art has made use of closed loop feedback control by direct comparison of the actual temperature with the desired temperature as a reference. In such case, an error signal is generated which causes a change in the power supply.

Instead of controlling the power supply in regard to temperature, magnetic forces have also been used as the control parameter, but this requires a strict and precise control of the current passing through the induction coil for any quality standard by heat treatment to be achieved.

An object of the present invention is to provide coil current control in an induction heating apparatus.

The invention rests on the observation that neither the voltage nor the power supplied to the tuned tank circuit has a direct relationship to the coil current.

Thus, for voltage control the coil current $I_C$ is given by the equation:

$$|I_C| = \frac{V_o}{\sqrt{R^2 + \left(\frac{f}{f_o}\right)^2 \frac{L}{C}}} \quad (1)$$

where

Vo=coil voltage;

R=coil resistance;

f=driving frequency;

$f_o$=resonant frequency of coil and tuning capacitors;

L=coil inductance;

C=tuning capacitor.

For power control the coil current $I_C$ is given by the equation:

$$|I_C| = \frac{P_o}{\sqrt{R^2 + \left(\frac{f}{f_o}\right)^2 \frac{L}{C}}} I_o \cos\phi \quad (2)$$

where in addition to the parameters of equation (1):

Po=power applied to the tank circuit under Vo and $I_o$;

$I_o$=current fed to the tank circuit;

$\phi$=phase angle between current $I_o$ and voltage Vo.

It appears that in both instances the coil current $I_C$ is dependent on the driving frequency from the power supply as well as upon the impedance of the coil. Since all the aforementioned parameters are susceptible of varying during the heating process, precise control cannot be achieved with either of these methods.

Direct coil current measurement is a serious problem with high frequency induction heating. Some processes incorporating high frequency induction equipment require precise control of coil current to properly control the end product. Such control demands the use of a coil current sensor that provides an accurate, representative current signal which can be conditioned and used for feedback information in the control system. Coil currents are generally 2 to 120 times the power supply current and most often are many thousands of amperes for processes requiring even modest powers (100 KW and up).

High frequency current measurements become more difficult with increasing frequency and amplitude of the current waveform. Although current shunts, magnetic pick-up devices, etc. are suitable, in principle, for the sensing element, current transformers provide reliable, accurate and economical alternatives. Properly designed and installed, the current transformer provides an isolated signal independent of frequency (within its design range). Conventional high current, high frequency current transformers using enameled wire wound on a 0.004 inch, 50% Ni-50% FE gain oriented tapewound cores suffice to levels of approximately 2500 amperes at 3 KHZ. However, at higher currents and/or frequencies the conventional approach is not effective.

SUMMARY OF THE INVENTION

Induction heating apparatus according to the present invention combines a special current measuring transformer for direct sensing of coil current and a closed loop for controlling the power supply in relation to the sensed coil current.

A high-frequency current measuring transformer is directly mounted in close association with coplanar sandwiched busses connecting the tank circuit of the induction heating apparatus to the heating coils thereof. The primary of the high-frequency current measuring transformer comprises one of the two coplanar sandwiched busses feeding high frequency high power current to the heating coils. The secondary coil is mounted on said one bus. It includes a magnetic core, a substantial number of ampere-turns surrounding said magnetic core and a heat sink in close relation to said ampere-turns and on the outside thereof.

The current measuring transformer according to the present invention combines the following essential features: (1) applying a high thermally conductive cement and providing water cooling to form an effective external heat sink to the outside surface of the winding; (2) using Litz wire to form the many ampere-turns of the secondary winding thereby to reduce eddy current losses; (3) having the core of the secondary winding water-cooled to provide an internal heat sink; (4) impregnating the core and winding of the secondary SC with high temperature silicon varnish or potting compound under vacuum thereby to fill all air voids and increase the thermal conductance to the cooling surfaces. While the wrapped high ampere-turns secondary is surrounded by a heat sink comprising a heat conductive cladding surrounding cooling medium flow passageways, said cladding is divided in at least two discrete parts separated by a gap preventing the formation of a parasitic secondary loop by electromagnetic induction from the primary bus therethrough.

DESCRIPTION OF THE PREFERRED EMBODIMENT

Figure 1:
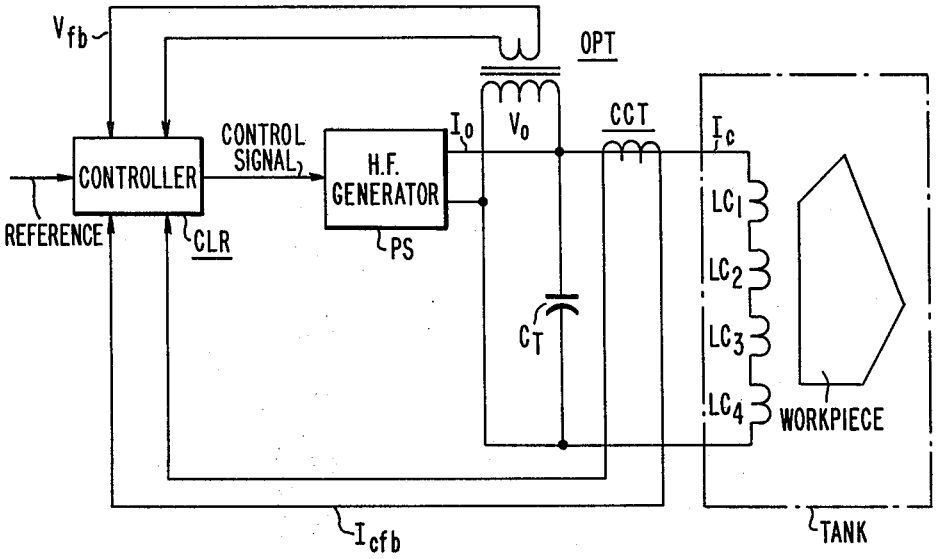
FIG. 1 is a schematic representation of a coil current controlled induction heating apparatus used according to the present invention.

Referring to FIG. 1, an induction heating apparatus is shown of the type disclosed in copending patent application Ser. No. 154,691 filed May 30, 1980. The copending application is hereby incorporated by reference.

Four induction coils in series $LC_1$, $LC_2$, $LC_3$ and $LC_4$ induce eddy currents in a workpiece when loaded by a high frequency, high power current $I_C$. The induction coils are part of a tank circuit including series capacitors symbolized by a capacitor $C_T$. A high frequency generator PS excites the tank circuit under a current $I_o$ and a voltage Vo. The high frequency generator is controlled in frequency and power by a controller circuit CLR in response to a reference signal and to feedback signals $I_{cfb}$ and $V_{fb}$ which are derived respectively from a current transformer CCT and a voltage transformer OPT. Transformer CCT, according to the present invention includes as primary one of two parallel and closely spaced feed lines to the induction coils which are passing the load $I_C$. The secondary SC comprises a high ampere-turns winding of Litz wire coupled with the primary line.

Figure 2:
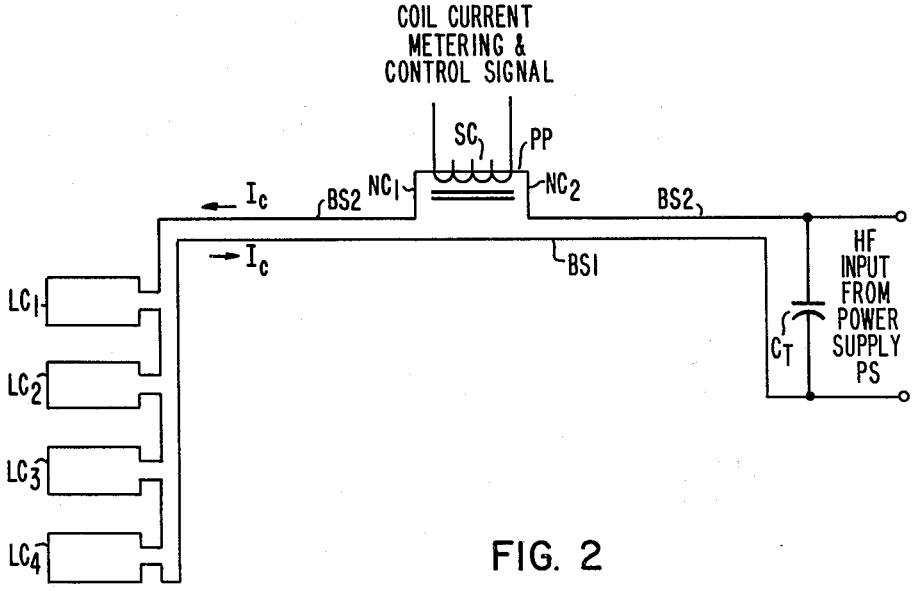
FIG. 2 schematically shows the coil current measuring transformer according to the present invention.

Referring to FIG. 2, the feed lines between tuning capacitors $C_T$ and the induction coils consists in coplanar sandwiched busses BS1, BS2 as required to handle the very high power high frequency current $I_C$. The current load $I_C$ passes one way through bus BS2 and returns on a proximate parallel path in bus BS1 to the tuning capacitors $C_T$. The secondary SC of the current measuring transformer CCT is coupled to a portion PP of bus BS2 which is parallel to BS2 but a distance therefrom sufficient to accommodate the ampere-turns, since BS2 and BS1 are very close to each other in their major portion. Portion PP of bus BS2 is connected at two ends to the main portion of bus BS2 by two connectors $CN_1$ and $CN_2$ which are in a direction perpendicular to the general direction of BS1 and BS2, thereby to minimize stray inductance.

Figure 3:
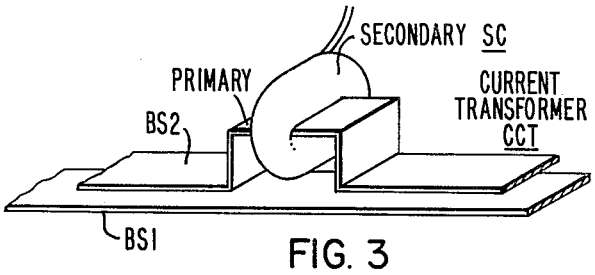
FIG. 3 shows in more detail the relative disposition of the primary and secondary of the coil current measuring transformer of FIG. 2.

FIG. 3 shows with more detail how the secondary SC of transformer CCT is mounted and accommodated within the half-loop formed by portions PP, $CN_1$ and $CN_2$ of bus BS2.

In the typical high frequency circuit arrangement of FIGS. 2 and 3, coil current is transmitted through low inductance busses and/or cables to the series connected coils with a half-loop in one bus BS2 containing the secondary SC. It is mandatory that the dimensions of the current loop be minimized to prevent excessive voltage drop in the high frequency circuit and to prevent stray heating of adjacent components and structure due to magnetic flux generation by the half-loop. However, the secondary SC is subjected to magnetic flux from bus BS1 carrying the opposite current, causing eddy currents to flow in the winding and core. Laboratory tests have shown that a conventional 6000A/6A current transformer (0.004 inch 50% Ni 50% FE tape wound core and 1000 turns #13AWG enameled wire) dissipates approximately 1000 watts when used in the manner shown in FIG. 2 and excited at 6000 amps leads to an excessive temperature rise and eventual failure of the current transformer. Actually, winding temperature may rise in excess of 160° C. have been experienced.

A unique design of the secondary SC for maximal heat dissipation combining eddy current minimization is provided by: (1) applying a high thermally conductive cement and providing water cooling to form an effective external heat sink to the outside surface of the winding; (2) using Litz wire to form the many ampere-turns of the secondary winding thereby to reduce eddy current losses; (3) having the core of the secondary winding water-cooled to provide an internal heat sink; (4) impregnating the core and winding of the secondary SC with high temperature silicon varnish or potting compound under vacuum thereby to fill all air voids and increase the thermal conductance to the cooling surfaces.

Figure 4:
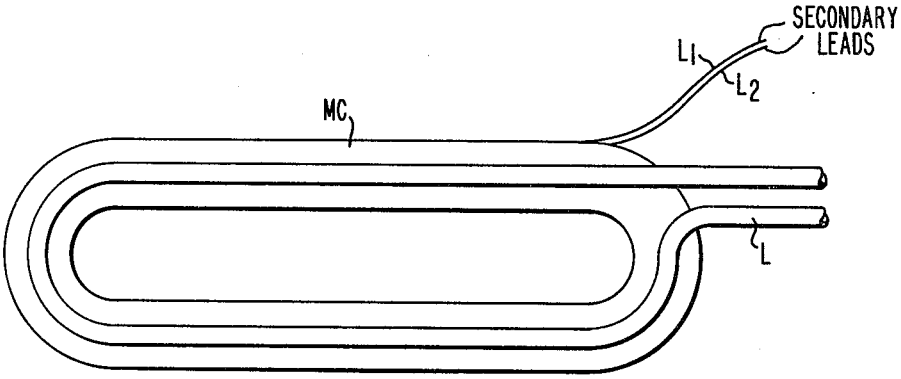
FIG. 4 shows the secondary of the transformer of FIGS. 2 and 3 with the associated cooling arrangement.
Figure 5:
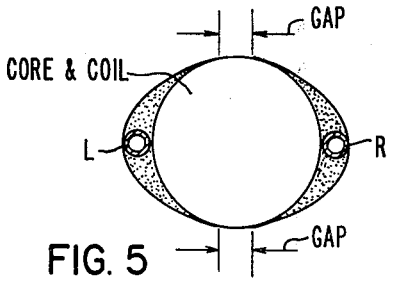
FIG. 5 shows the disposition of the heat sink around the core and winding of the secondary of the transformer of FIGS. 2 and 3.

FIG. 4 shows the secondary SC in association with the external cooling system and FIG. 5 is a cross-section illustrative of how the external heat sink is disposed around the main coil of the secondary SC. External cooling is obtained by disposing two copper cooling tubes on opposite sides of the winding. FIG. 4 shows the left tube L only. The right tube R which would appear behind the main coil MC has not been shown for the purpose of clarity. The two cooling tubes R and L are cemented to the outside surface of MC. The cement has a high thermal conductivity and is also a good thermal conductor. This is a commercial cement having graphite as an additive providing a good isothermic quality. A heat transfer cement is known on the market place as "Thermon T-63" sold by Thermon Manufacturing Company. It has been used extensively on piping of heat exchangers. Referring to FIG. 5, the cement is applied to cover the entire outside surface except for a small gap along the portions which are the farthest from the cooling tubes R and L, namely outside and inside the doughnut-shaped main coil MC. These gaps prevent a shorted electrical turn around the magnetic core. Accordingly, the outside surface of the main coil MC becomes a low temperature isothermal surface, the cooling water flowing through tubes L and R being the final heat transfer medium. Furthermore, the thermal cement being a good electrical conductor, as well, provides a degree of shielding to the secondary winding of the transformer which tends to reduce internal eddy current losses.

Figure 6:
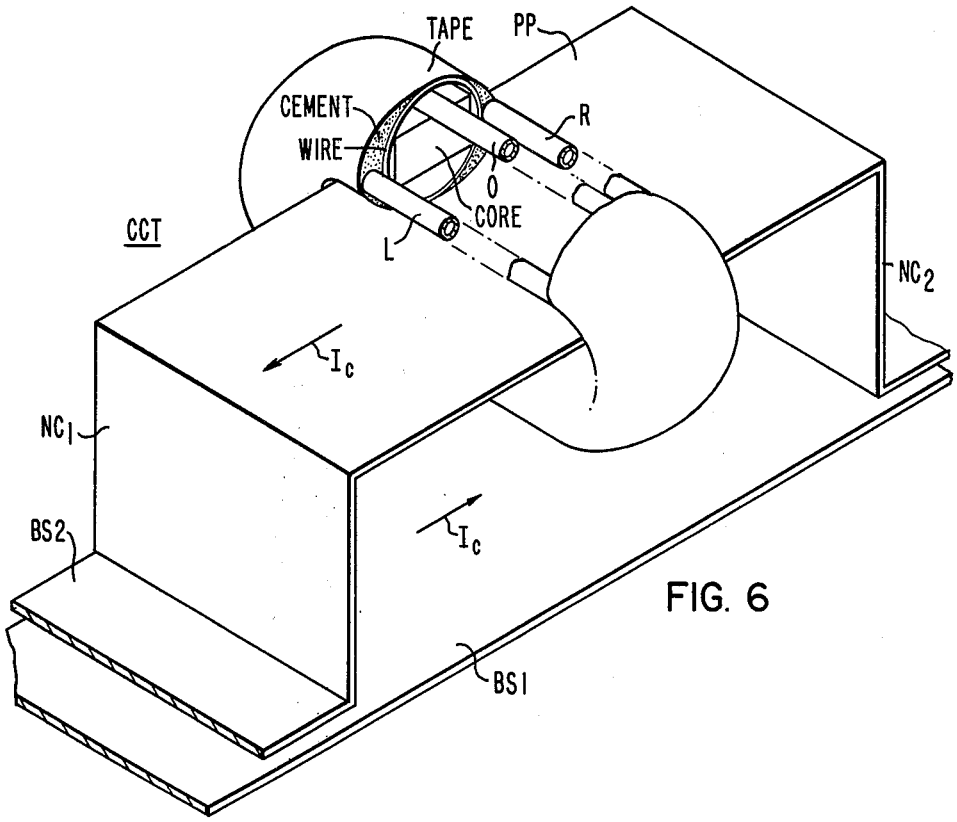
FIG. 6 is a perspective view of the transformer according to the present invention.

As shown in FIG. 6, besides two loops L and R of copper tubes providing external cooling, another loop O is provided peripherally of the magnetic core of the secondary winding, namely inside the winding itself, e.g. the Litz wire is wound around the cooling tube O.

The secondary is thus provided with two main heat paths through a relatively high conductance impregnation mainly to the external water cooled surface, but also to the internally water cooled core. This results in acceptable low winding temperatures despite high internal power losses.

The Litz wire is wound in several layers, around the core and the central tube O, to about 1000 turns.

Figure 7A:
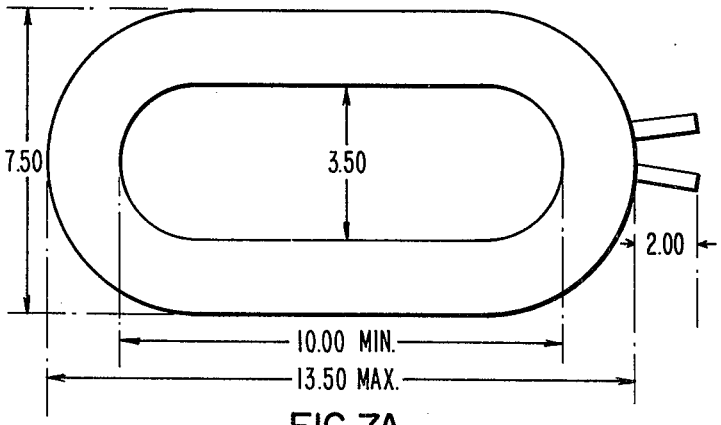
FIGS. 7A and 7B show a secondary winding with typical dimensioning.
Figure 7B:
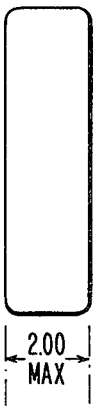

FIGS. 7A and 7B show the secondary SC with actual dimensions given in inches as an example: The outer length of the doughnut-shaped coil is 13.50, the inner length is 10.00, the transversal dimension of the central opening is 3.50, the outer transversal dimension is 7.50, while the overall thickness is 2.00. The current transformer current ratio is 7000 A/7A with the following actual characteristics:

| | | |
|---|---|---|
| Frequency | = | 3KHZ |
| Primary I | = | 7000 amps |
| Secondary I | = | 7 amps |
| Inlet Water Temperature | = | 20° C. |
| Average Winding Temperature | = | 79.7° C. (Measure by change of resistance method) |
| Average Winding Temperature Rise | = | 59.7° C. (Above water temperature) |
| Total Power Losses | = | 2381 Watts |
| Rated Winding and Coil Temperature | = | 120° C. Max. |
| VA Rating | = | 100 volt amps |
| Core Material | = | 4 MIL Selectron |
| Core Area | = | 0.52 $in^2$ |
| Insulation | = | Temperature Class 130° C. |
| 100 turns of Litz wire 63 strands of #30 (Class 130° C. Minimum) | | |
| Glass Weave tape between layers | | |
| Vacuum impregnated with 155° Class Varnish | | |

These results indicate that the transformer is suitable for even higher currents and/or frequencies since the operating temperature level is rated well below.

We claim:

1. In an induction heating apparatus having induction coil means supplied through two closely related parallel conductors with high frequency high power current from a tank circuit energized by a power generator, the combination of:

said parallel conductors having a predetermined distance therebetween along a portion thereof;

a toroidal secondary winding of Litz wire disposed along said portion and around one of said conductors in transformer relationship with said power current for deriving a coil current signal representative of said power current;

with said toroidal secondary winding including a toroidal inner magnetic core and being oriented in a plane normal to said portion;

with at least one outer cooling tube being mounted in heat transfer relation with said secondary winding by means of a thermally conductive cement extending over at least one substantial portion of the outer surface of said secondary winding and surrounding said outer cooling tube; and means for providing an air-tight seal adjacent said thermally conductive cement by impregnation of said magnetic core and secondary winding;

said predetermined distance accommodating (a) said impregnated toroidal secondary winding, (b) said at least one outer cooling tube, and (c) said surrounding cement.

2. The induction heating apparatus of claim 1 with two said outer cooling tubes being mounted on two opposite sides of said secondary winding in heat transfer relation therewith over corresponding respective substantial surface portions thereof; with a gap being provided between the conductive cement associated with said substantial surface portions.

3. The induction heating apparatus of claim 2 with said outer cooling tubes being disposed laterally of said toroidal secondary winding and on opposite sides.

4. The induction heating apparatus of claim 3 with said gaps being centered on the outer and the inner cross-section line in a plane of symmetry normal to said parallel conductors.

5. The induction heating apparatus of claim 4 with an inner cooling tube being provided between said Litz wire winding and said magnetic core.

6. The induction heating apparatus of claim 5 with a cooling agent being circulated through said outer and inner cooling tubes.

* * * * *